US005862723A

United States Patent [19]

Rowlands

[11] Patent Number: 5,862,723

[45] Date of Patent: Jan. 26, 1999

[54] PIVOT HEAD WRENCH

[76] Inventor: Albert J. Rowlands, Rte. 6, Box 360, Charleston, W. Va. 25311

[21] Appl. No.: 880,074

[22] Filed: Jun. 20, 1997

[51] Int. Cl.[6] ..... B25B 23/16

[52] U.S. Cl. ..... 81/177.9; 81/177.85

[58] Field of Search ..... 81/177.8, 177.9, 81/177.7, 177.85

[56] References Cited

U.S. PATENT DOCUMENTS

| | | | |
|---|---|---|---|
| 1,325,407 | 12/1919 | Morgan | 81/177.7 |
| 1,431,389 | 10/1922 | Frisz . | |
| 2,028,561 | 1/1936 | Pilger . | |
| 2,294,510 | 9/1942 | Nakano . | |
| 2,671,367 | 3/1954 | Modin . | |
| 3,039,340 | 6/1962 | Livermont | 81/177.85 |
| 3,186,265 | 6/1965 | Wenturine et al. . | |
| 3,270,597 | 9/1966 | Neff et al. . | |
| 3,348,436 | 10/1967 | Robinson . | |
| 3,383,962 | 5/1968 | Harris . | |
| 4,327,611 | 5/1982 | Catanese et al. . | |
| 4,463,632 | 8/1984 | Parke . | |
| 4,581,959 | 4/1986 | Troiano . | |

*Primary Examiner*—James G. Smith
*Assistant Examiner*—Benjamin M. Halpern
*Attorney, Agent, or Firm*—Robert N. Blackmon

[57] ABSTRACT

The present invention involves a pivot head wrench having a body section pivotally connected to a handle section, and further having locking means for locking the relative angular position of the body section and the handle section. The locking means comprises a receiver surface on one of the sections, a ball engaging the receiver surface, and a ball position controller comprising a pin having a stepped shape. The pin has a first surface which forces the ball into locking engagement with the receiver surface, and has a second position which permits disengagement of the ball from the receiver surface for permitting pivoting of the head. The spring is biased in a position where the first service engages the ball for locking the orientation of the head section relative to the handle section.

16 Claims, 3 Drawing Sheets

PIVOT HEAD WRENCH

BACKGROUND OF THE INVENTION

1. Field of the Invention

The present invention relates to wrenches, and more particularly relates to wrenches having pivotal heads.

2. Description of the Related Art

Various prior wrench designs are known, including fixed head wrenches, wrenches that have heads that pivot and are biased in a particular selected position, and wrenches which have heads which pivot and are locked in a given position having either locking mechanisms involving twisting or locking mechanisms involving high profile excessive externals which can interfere with a worker's utilization of the wrench. Prior wrenches having biased unlocked positions undesirably permitted the user to over torque the bias resulting in undesired and unintended rapid overmovement of the users hand possibly resulting in the users hand forcibly hitting adjacent work surfaces.

Consequently, there is a need and desire for wrenches having pivot heads which are simple, quick and easy to use and have a minimal profile for minimizing the risk of interference with work surface areas.

SUMMARY OF THE INVENTION

The present invention involves a pivot head wrench having a body section unit pivotally connected to a handle section unit, and further having locking means for locking the relative angular position of the body section and the handle section. The locking means comprises a receiver surface on one of the sections, a ball engaging the receiver surface, and a ball position controller comprising a pin having a stepped shape. The pin has a first surface which forces the ball into locking engagement with the receiver surface, and has a second position which permits disengagement of the ball from the receiver surface for permitting pivoting of the head. The spring is biased in a position where the first service engages the ball for locking the orientation of the head section relative to the handle section.

DETAILED DESCRIPTION OF THE INVENTION

Figure 1:
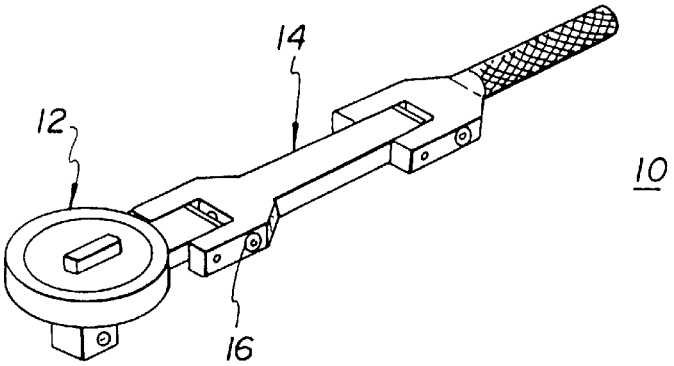
FIG. 1 is a perspective view of the pivot head wrench of the present invention.
Figure 2:
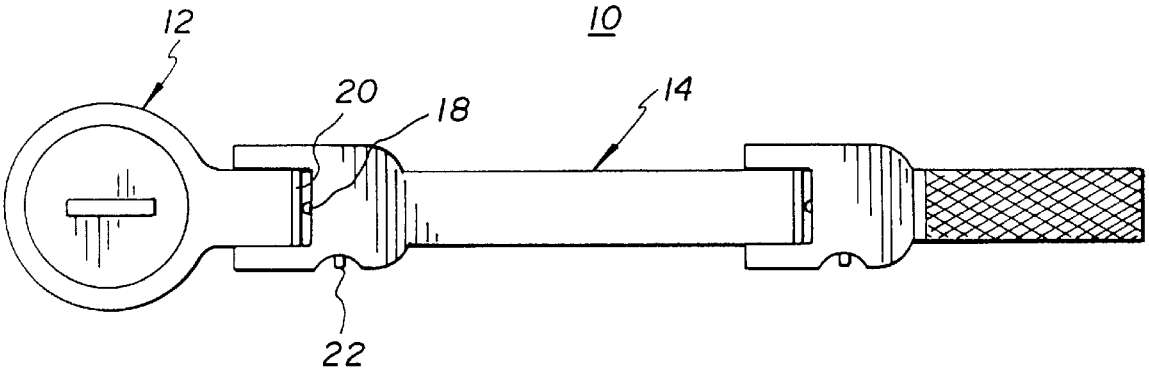
FIG. 2 is top plan view of the wrench of the present invention.
Figure 3:
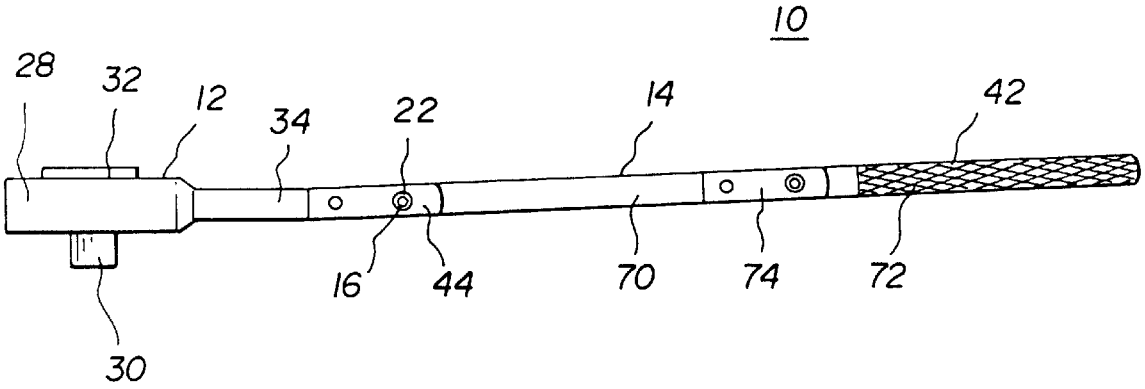
FIG. 3 is a side elevational view of the wrench of the present invention.

The present invention involves a pivot head wrench (10) comprising (a) a wrench head unit (section) (12), (b) a handle unit (section) (14) pivotally attached to the head unit (12), and (c) a locking means (16) for releasably locking the position of the head (12) relative to the handle (14). The locking means (16) comprises (i) a ball (18), (ii) a receiver (20) for a receiving the ball (18), and (iii) a shaped pin (22) engaging the ball (18). The pin (22) has a first (outer) ball engaging surface (24) and a (stepped down, inner) second ball engaging surface (26), the first ball engaging surface (24) being closer to the receiver (20) than the second ball engaging surface (26) is to the receiver (20). The pin (22) is biased in a position with the first surface (24) being in engagement with the ball (18) for locking the relative angular position of the head unit (12) to the handle unit (14).

As can be seen in FIGS. 1, 2, 3 and 4, the head unit (12) has a working portion (28) which may be similar to conventional wrench working portion such as a socket receiving portion of a conventional wrench or a bolt head receiving portion of a conventional wrench. As shown in the present figures, the working portion is depicted as a socket receiving portion having a socket receiving post (30) and a ratchet control switch (32) for permitting the user to control the effective direction of the ratchet action. The head unit (12) also has the pivot portion (34) attached to the working portion (28), and the pivot portion (34) preferably has the receiver (20) at a distal end thereof. The receiver (20) preferably is in the form of a gear type surface (36) having a plurality of arcuately arranged ridges (38) spaced apart from each other to form ball receiving valleys (40) (recesses) . When the ball (18) is in the locking position, the ball (18) is wedged between two adjacent ridges thereby preventing pivoting of the head section (12) relative to the handle section (14).

Figure 5:
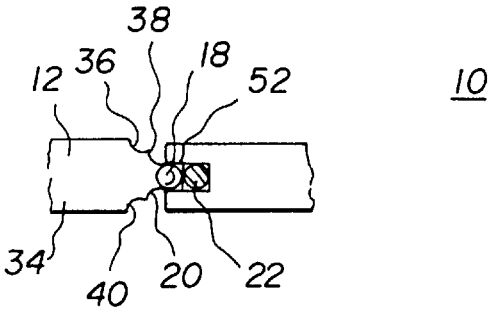
FIG. 5 is a cutaway vertical cross-sectional view of the wrench of the present invention.
Figure 4:
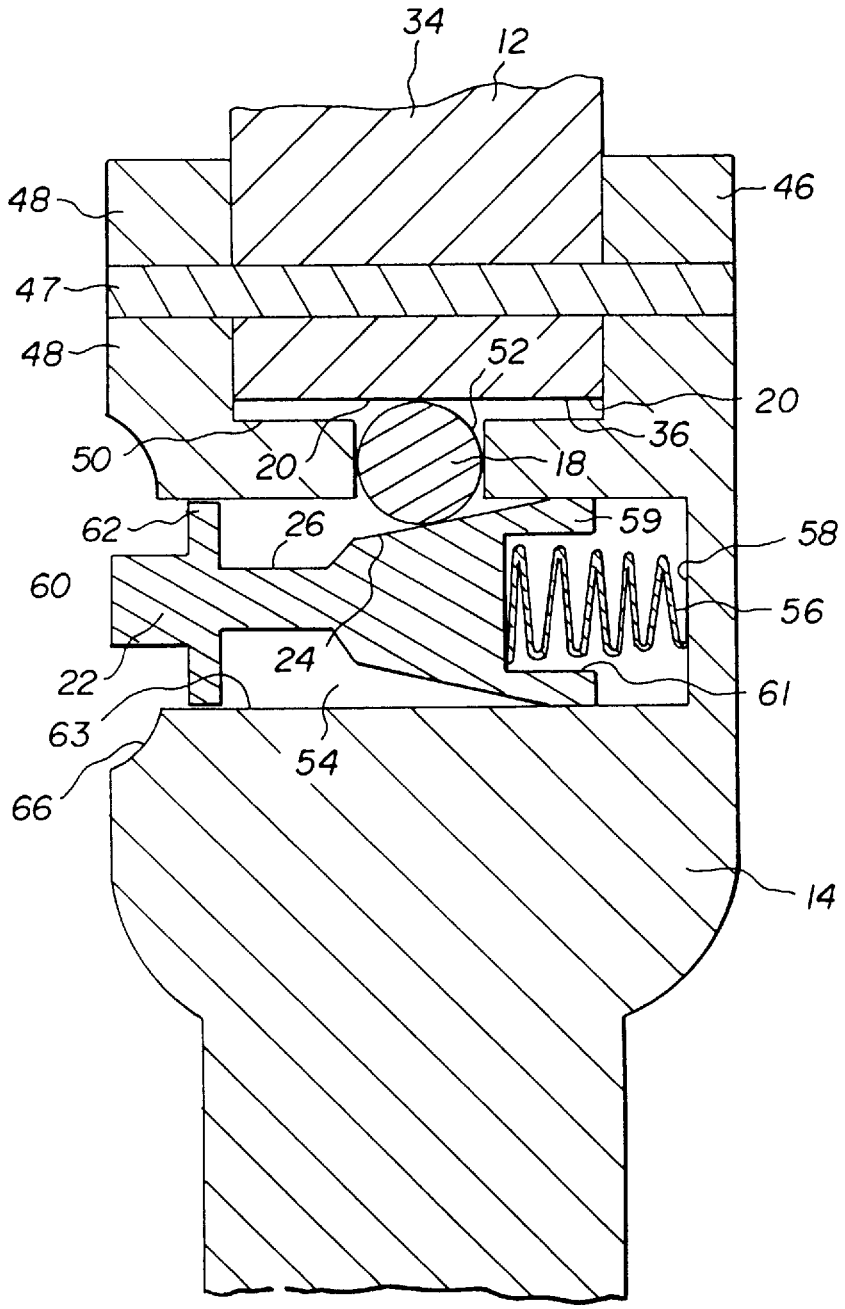
FIG. 4 is a cutaway horizontal cross-sectional view of the wrench of the present invention.

The handle section (14) has a hand engaging portion (42) and a locking portion (44). The hand engaging portion (42) may be of a conventional shape, such as one having a cross-hatched textured friction enhancing surface. The locking portion (44) is preferably integral with the hand engaging portion (42). The locking portion (44) preferably has a pair of spaced apart fingers (46, 48) providing the locking portion (42) with a U-shaped distal end for receiving the pivot portion (34) of the head unit (12). A pivot element (47) extends through the fingers (46, 48) and through the pivot portion (34) for pivotally securing the head section (12) to the handle section (14). The locking portion (44) has a ball receiving surface (50) extending between the rear most regions of the fingers (46, 48) and adjacent to the surface (36). As best shown in FIGS. 4 and 5, the locking portion (44) further comprises a longitudinal hole (52) extending longitudinally from the ball receiving surface (50) along the longitudinal axis of the handle (14) for receiving the ball (18) and permitting longitudinal movement of the ball (18) into and out of engagement with the gear type surface (36) (the gear type surface may be replaced with dish shaped recesses). The locking portion (44) further includes a transverse pin receiving recess (54) extending into the handle section (14) and transverse of the longitudinal hole (52). The transverse recess (54) receives the pin (22) and a pin biasing spring (56). The spring (56) is preferably positioned between an end wall(58) at one end of the recess (54) and is received within a cup (61) at a distal end (59) of the pin (22). The second surface (26) is preferably adjacent to the spring (56). The pin (22) extends from the pin distal end (59) engaging the spring (56) to an outermost end (60) for engagement with the user's finger. The first surface (24) extends from the end (59) to the second surface (26). The pin (22) preferably has an annular retention ring (62) positioned adjacent to the exterior of the handle unit (14) for engaging the interior surface (63) of the recess (54) for permitting linear movement of the pin along the length of the recess (54). The pin (22) is retained within the recess (54) by the tapered shape of the first surface (24) which is adjacent the distal end (59) engages the interior surface of the recess (54) and has a diameter that is too large to slip past the ball (18) due to the engagement of the ball (18) with the pivot portion (34) thereby retaining the pin (22) within the recess (54). This tapered shape allows for the use of a minimum of parts in the manufacture of the wrench. The outer end (60) of the pin (22) extends outwardly beyond the recess (54) and into a recessed (dish shaped, concave) cavity (66) on the exterior of the handle section (14). The recessed cavity (66) allows the user of the tool to access the finger engaging outer end (60) of the pin (22) and yet permits the pin to be effectively recessed thereby reducing the risk of unintentional engagement of the pin (22) with various work surfaces encountered by the user. When being used in tight work areas, the recessed pin effectively avoids contact with various work items. The adjustable pivot head allows use of the wrench in order to avoid objects such as metal objects, wires and hoses. The handle can be moved to ninety degrees (90°) below the plane of the ratchet and ninety degrees (90°) above the plane of the ratchet and various positions in between. The wrench is adjustable simply by pushing the button (pin) thereby unlocking the handle and permitting the handle to be moved to the desired position. Releasing the button (pin) thereby locks the handle in the desired position. Optionally, preferably the handle section (14) may be formed by having two handle subsections (70, 72) interconnected by a locking subassembly (74) similar and/or identical to the locking means set forth above. By utilizing subassemblies in the handle, the grip part of the handle can be moved in a manner similar to the movement of the head unit relative to the handle section. The grip subsection of the handle can thus be swung in one hundred eighty degrees (180°) or any position relative thereto can be locked in a comfortable position thereby allowing elimination of many specialty wrenches and permitting the handle to effectively act as an extension or by positioning the grip in a ninety degree (90°) position can be effectively used as a speed wrench.

What is claimed is:

1. A pivot head wrench comprising:

(a) a wrench head unit, (b) a handle unit pivotally attached to the wrench head unit, (c) locking means for releasably locking the position of the head unit relative to the handle unit, said locking means comprising:

(i) a ball, (ii) a receiver for said ball, (iii) a tapered pin engaging said ball, said pin tapering from a first ball engaging surface to a second ball engaging surface for engaging said ball, said pin being biased in a first position with said first ball engaging surface engaging said ball.

2. The wrench of claim 1 wherein said receiver is on said head unit, said receiver comprising a plurality of arcuately spaced ridges.

3. The wrench of claim 1 wherein said handle unit has said pin positioned within said handle unit.

4. The wrench of claim 1 wherein said handle has a plurality of pivotally adjustable handle subsections.

5. The wrench of claim 1, wherein said pin has a cup receiving a spring.

6. The wrench of claim 1, wherein said pin is tapered.

7. The wrench according to claim 1, where said pin has a longitudinal axis transverse to a longitudinal axis of said handle unit, and said pin is axially symmetric about said longitudinal axis for providing a continuous surface on said pin for engaging said ball.

8. The wrench according to claim 1, wherein said locking means further includes means defining a substantially cylindrical receiving recess in said handle unit having a closed end and an open end for receiving said pin, said receiving hole having a longitudinal axis for slidingly receiving said pin about said longitudinal axis and said receiving hole longitudinal axis being substantially transverse to a longitudinal axis of said handle unit.

9. The wrench according to claim 8, where said pin has a longitudinal axis transverse to a longitudinal axis of said handle unit, and said pin is axially symmetric about said longitudinal axis for providing a continuous surface on said pin for engaging said ball and allowing rotation of said pin within said transverse receiving recess.

10. The wrench according to claim 9, said locking means further comprising a spring located within said transverse receiving recess to bias said tapered pin in said first position and being compressible to allow said pin to move to a second position having said second ball engaging surface engaging said ball.

11. The wrench according to claim 10, wherein said tapered pin further comprises a frustoconical body wherein said first ball engaging surface is frustoconical and said second ball engaging surface is frustoconical.

12. The wrench according to claim 10 wherein said wherein said pin has means defining a cup within said frustoconical body for receiving a spring for providing a biasing force against said pin.

13. The wrench according to claim 8, wherein said transverse receiving recess open end communicates with an exterior of said handle unit, said pin having an outermost portion extending beyond said open end of said transverse receiving recess in said handle unit for allowing access to said pin by a user to move said pin along said recess longitudinal axis from said first position to a second position with said second ball engaging surface engaging said ball.

14. The wrench according to claim 13, wherein said handle unit has a means defining a recessed cavity in communication with said transverse receiving hole to provide access to said pin.

15. The wrench of claim 8, further comprising a pin retention means for retaining said pin within said recess wherein said pin retention means is said ball.

16. The wrench of claim 1, wherein said locking means consists essentially of said ball, said receiver, said pin, said spring, and means defining a recess in said handle unit to receive said pin and said spring.

* * * * *